US007291835B2

(12) United States Patent
Overney

(10) Patent No.: US 7,291,835 B2
(45) Date of Patent: Nov. 6, 2007

(54) APPARATUS AND METHOD FOR MALDI SOURCE CONTROL WITH EXTERNAL IMAGE CAPTURE

(75) Inventor: Gregor T. Overney, Sunnyvale, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 0 days.

(21) Appl. No.: 11/501,529

(22) Filed: Aug. 8, 2006

(65) Prior Publication Data

US 2006/0284078 A1 Dec. 21, 2006

Related U.S. Application Data

(60) Division of application No. 10/636,459, filed on Aug. 6, 2003, now Pat. No. 7,145,135, which is a continuation-in-part of application No. 10/452,769, filed on May 30, 2003.

(51) Int. Cl.
*H01J 49/04* (2006.01)

(52) U.S. Cl. ..... 250/288; 702/19; 702/22; 436/164; 422/82.05

(58) Field of Classification Search ..... 250/288, 250/281, 282, 287; 702/19, 22, 30; 436/164; 422/82.05

See application file for complete search history.

(56) References Cited

U.S. PATENT DOCUMENTS 5,498,545 A 3/1996 Vestal
5,770,860 A 6/1998 Franzen
5,808,300 A 9/1998 Caprioli
5,969,350 A 10/1999 Kerley et al.
6,111,251 A 8/2000 Hillenkamp et al.
6,175,112 B1 1/2001 Karger et al.
RE37,485 E 12/2001 Vestal
6,414,306 B1 7/2002 Mayer-Posner et al.
6,423,966 B2 7/2002 Hillenkamp et al.
6,454,938 B2 9/2002 Moon et al.
6,465,778 B1 10/2002 Koster et al.
6,485,913 B1 11/2002 Becker et al.
6,508,986 B1 1/2003 Anderson et al.
6,701,254 B1 3/2004 Williams et al.
6,855,925 B2 2/2005 Ellson et al.
7,145,135 B1 * 12/2006 Overney ..... 250/288
2002/0191864 A1 12/2002 Lennon et al.

OTHER PUBLICATIONS

Rebecca W. Garden and Jonathan V. Sweedler, et al., "Heterogeneity within MALDI Samples as Revealed by Mass Spectrometric Imaging," Analytical Chemistry, vol. 72, No. 1, Jan. 1, 2000, pp. 30-36.

* cited by examiner

*Primary Examiner*—Kiet T. Nguyen

(57) ABSTRACT

A method of MALDI sample plate processing includes capturing an image of a plate positioned outside a mass spectrometer. The image is processed to identify one or more attributes of an individual sample on the plate, where the attributes are selected from a position attribute, a geometry attribute and an internal density distribution attribute. A laser impact position is selected within the mass spectrometer based upon one or more of the attributes.

14 Claims, 13 Drawing Sheets

Determine neighbors for all atoms

```
for (i = 0; i < countatoms- 1; i++)
{
        for (j = i + 1;j < countatoms- 1;j++)
        {
                [check if atom 'j' is neighbor of atom 'i']
                [If yes, add the index of 'j' to the list of neighbors of atom 'i']
        }
}
```

Assign each atom to a cluster using radial cut off (rcut)

```
for (i = 0; i < countatoms; i++)
{
 [if atom 'i' has not yet been assigned to a cluster (not yet checked)]
 {
  counter = 0;   // initialize general counter for cluster size
  clusterIndexCounter++; // increase unique cluster index
  [if number of neighbors of atom 'i' is larger zero]
  {
   checkCluster(index'i', counter, clusterIndexCounter);
  }
  [if atom is isolated]
  {
   label atom 'i' as checked;
   set unique cluster index counter of atom 'i' to be clusterIndexCounter;
```

*See Fig. 7B*

*FIG. 7A*

*See Fig. 7A*

```
    counter++; // set counter to one for this isolated atom
   }
   [check cluster to test if largest cluster so far and, if yes, store clusterIndexCounter]
   [add size of cluster plus its unique cluster index to vectors clusterSize and clusterIDs,
respectively]
   sumCounter += counter;    // add to total number of assigned (checked) atoms
  }
}
```

The method ***checkCluster*(...) is called recursively to allow traversing through tree. The following is the essential workflow of method *checkCluster*(...)**:

```
ImageFreature::checkCluster (
                              atom index 'ii',
                              reference to cluster size counter,
                              reference to cluster index counterclusterIndexCounter
                              )
{
 set atom 'ii' as checked;
 set unique cluster index counter of atom 'ii' to be clusterIndexCounter;
 increase counter by one (remark: this is a reference and not a local variable)
 for (k = 0;k < number of neighbors of atom 'ii'; k++)
 {
  [select neighbor 'k' of atom 'ii']
  [has atom 'k' not yet been checked (or assigned to a cluster)?]
  {
   [yes: call method checkCluster(atom index'k', value of counter; value of
clusterIndexCounter)]
  }
 }
}
```

*FIG. 7B*

APPARATUS AND METHOD FOR MALDI SOURCE CONTROL WITH EXTERNAL IMAGE CAPTURE

REFERENCE TO RELATED APPLICATIONS

This application is a divisional application of U.S. patent application entitled "Apparatus and Method for MALDI Source Control with External Image Capture," Ser. No. 10/636,459, filed Aug. 6, 2003, issued as U.S. Pat. No. 7,145,135, which is a continuation-in-part application of U.S. Patent Application entitled, "Apparatus and Method for Automated MALDI Source Control," Ser. No. 10/452,769, filed May 30, 2003, the contents of which are hereby incorporated by reference in their entirety.

BRIEF DESCRIPTION OF THE INVENTION

This invention relates generally to mass spectrometry. More particularly, this invention relates to an automated source control system for a Matrix-Assisted Laser Desorption Ionization (MALDI) mass spectrometer.

BACKGROUND OF THE INVENTION

Matrix-Assisted Laser Desorption Ionization (MALDI) is a process that generates ions from analyte molecules within a sample. The molecules are initially embedded in a photon absorbing material or matrix as crystals and the matrix is then irradiated by a laser beam to produce desorption and eventually ions. Ionization efficiency is predicated upon the laser beam impacting crystals of analyte and matrix. Groups of crystals are referred to as clusters. If the laser beam is arbitrarily applied to a sample, then the laser beam might not impact crystals at an appropriate position or it might miss the crystals altogether.

There is an ongoing trend in MALDI technology to decrease sample size and increase the number of samples per MALDI plate by decreasing the distance between adjacent samples. The smaller sample size increases the likelihood that a laser beam will miss a sample. In addition, the smaller sample size makes it more difficult to identify an ideal location for laser impact. The increasing number of samples on a MALDI plate is placing a premium on processing speed and efficiency.

Most commercial MALDI systems include a video camera that allows an operator to monitor the actual location where a laser beam impacts a sample. The operator manually checks the location and makes manual adjustments, as necessary. This approach is time consuming. In addition, this manual process is becoming increasingly less useful as the sample sizes decrease.

In view of the foregoing, it would be highly desirable to provide an improved technique for generating ions from molecules within a sample processed by a MALDI system. The technique should be automated for high throughput and should accurately assess samples to identify optimal locations for laser impingement. Preferably, the sample assessment would consider the positions, geometries, and internal distribution of candidate clusters within a sample.

SUMMARY OF THE INVENTION

The invention includes a method of MALDI sample plate processing. The method includes capturing an image of a plate positioned outside a mass spectrometer. The image is processed to identify one or more attributes of an individual sample on the plate, where the attributes are selected from a position attribute, a geometry attribute and an internal density distribution attribute. A laser impact position is selected within the mass spectrometer based upon one or more of the attributes.

The invention includes an alternate method of MALDI sample plate processing. This embodiment includes capturing an image of a plate positioned outside a mass spectrometer. The image is processed to identify plate position information. The plate is positioned within the mass spectrometer in accordance with the plate position information.

The invention also includes an apparatus for automated MALDI sample plate processing. The apparatus includes a mass spectrometer, a camera positioned external to the mass spectrometer, and a computation device. The computation device includes a control circuit and a computer readable medium connected to the control circuit. The computer readable medium stores executable instructions to capture an image of a plate produced by the camera and identify at least one attribute of a sample on the plate. The attribute is selected from a position attribute, a geometry attribute and an internal density distribution attribute. A laser impact position is then selected within the mass spectrometer based upon the at least one attribute.

The invention includes a computer readable medium with executable instructions to receive an image of a plate positioned outside a mass spectrometer and process the image to identify at least one attribute of an individual sample on the plate. The attribute is selected from a position attribute, a geometry attribute and an internal density distribution attribute. A laser impact position is selected within the mass spectrometer based upon the at least one attribute.

BRIEF DESCRIPTION OF THE FIGURES

The invention is more fully appreciated in connection with the following detailed description taken in conjunction with the accompanying drawings, in which:

FIG. 7 illustrates nearest neighbor pixel processing performed in accordance with an embodiment of the invention.

Like reference numerals refer to corresponding parts throughout the several views of the drawings.

DETAILED DESCRIPTION OF THE INVENTION

Figure 1:
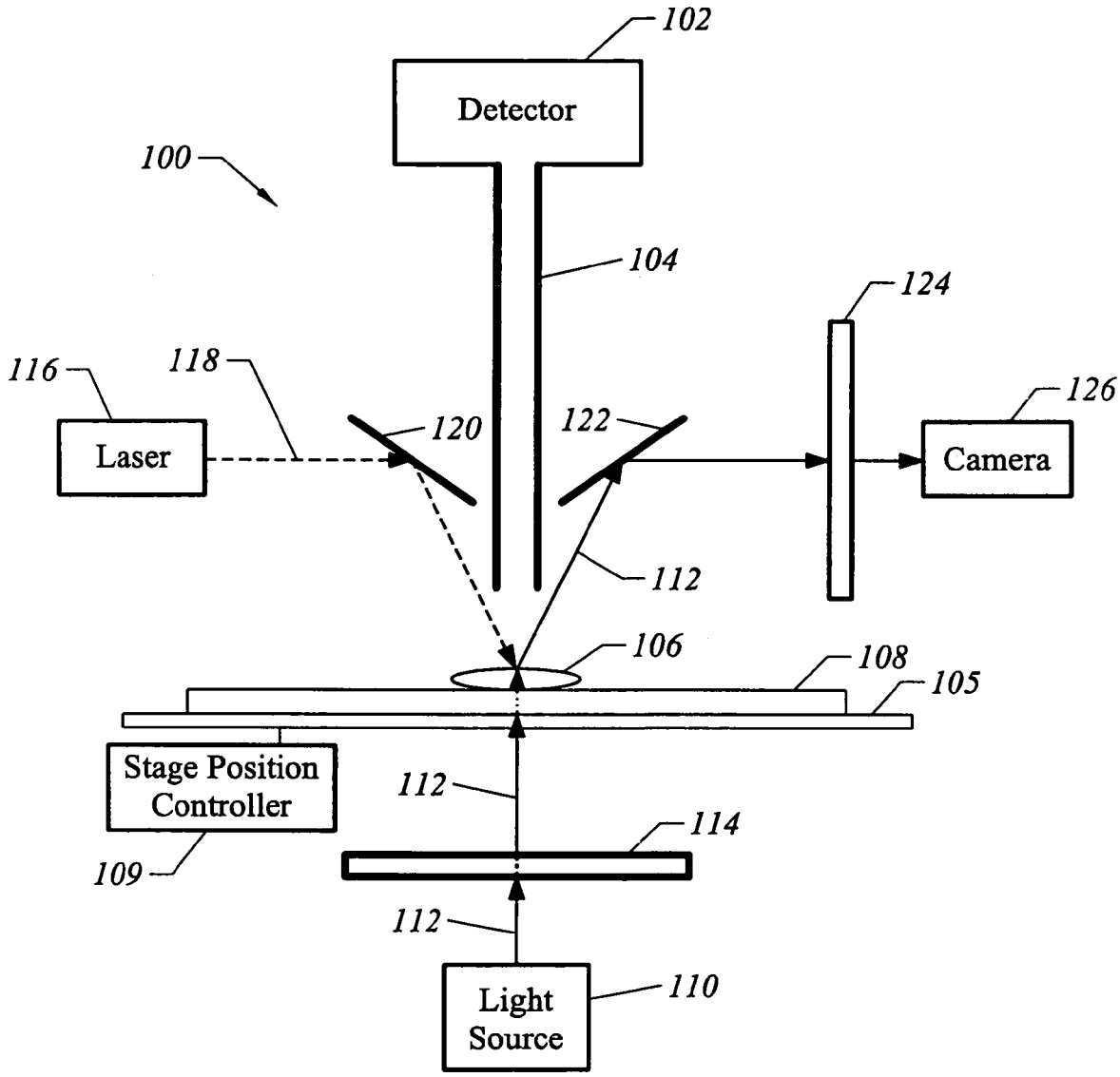
FIG. 1 illustrates a MALDI mass spectrometer configured in accordance with an embodiment of the invention.

FIG. 1 illustrates a MALDI mass spectrometer system 100 configured in accordance with an embodiment of the invention. The system 100 includes a detector 102 for processing ions in a vaporized sample delivered through a capillary extension 104. The vaporized sample is produced from a sample 106 deposited upon a sample holder 108. The transparent sample holder is mounted on a stage 105 having a stage position controller 109 to provide position control in an x-y plane. Components 102-109 are well known in the art and therefore may be successfully incorporated with features of the invention, which are discussed below.

The system 100 also includes a light source 110, which generates a light beam 112, which passes through a polarizer 114, before impinging upon the backside of the transparent sample holder 108. The light beam 112 passes through the sample 106 and is deflected, in this embodiment, by a mirror 122. The deflected beam is then passed through a second polarizer 124. A camera 126, such as a Charge Coupled Device (CCD) camera, then captures the resultant image. As discussed below, the image is processed and, if necessary, the position of the stage 105 is altered by the stage position controller 109 so that a laser bean 118 formed by a laser 116 impinges the sample 106 at an optimal position. After vaporization of a sample 106, the stage position controller 109 alters the position of the stage 108 so that the next sample can be processed.

Advantageously, the invention uses polarizers 114 and 124 to reduce the intensity of reflected light. In addition, the polarizers enhance contrast when molecules are optically active (i.e., molecules change polarization of light).

Figure 2:
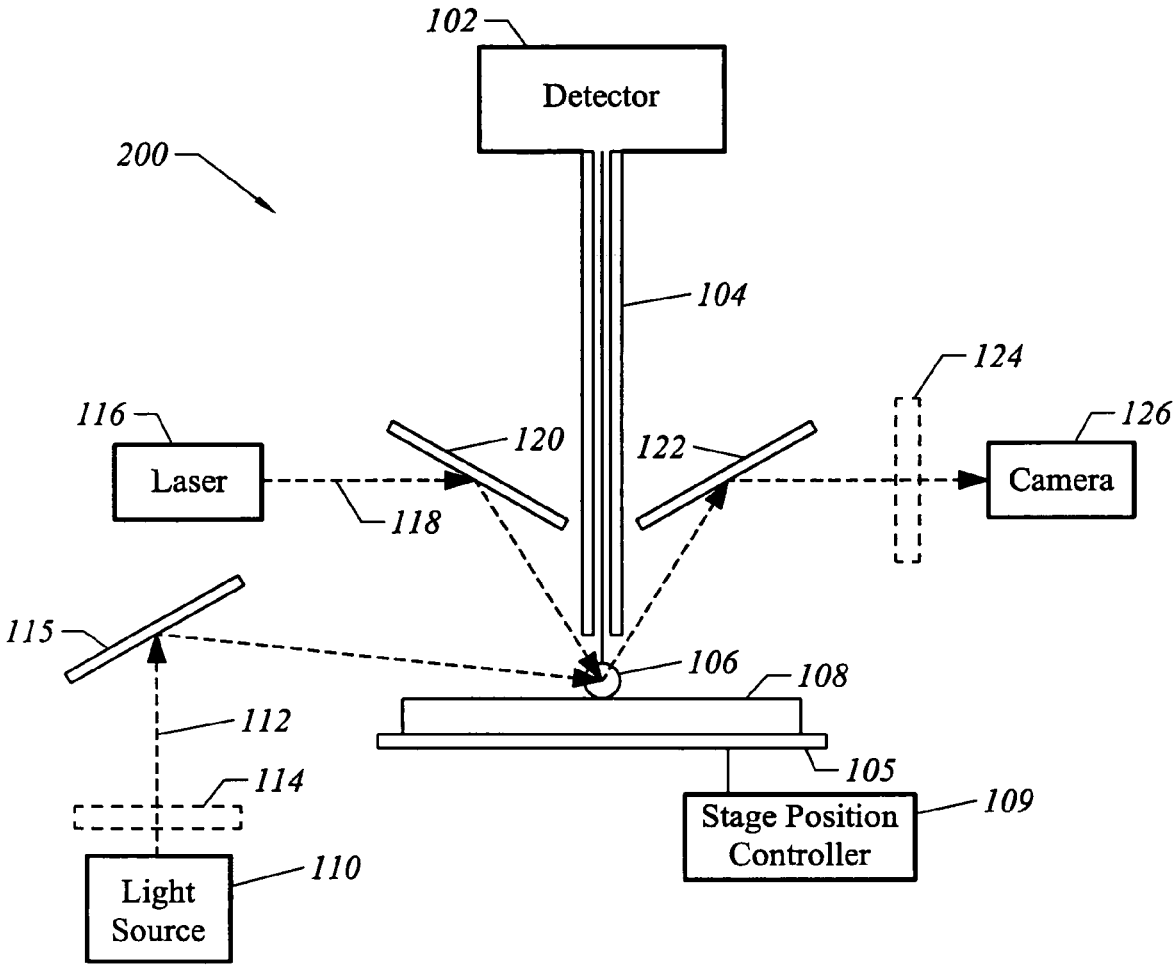
FIG. 2 illustrates a MALDI mass spectrometer configured in accordance with another embodiment of the invention.

FIG. 2 illustrates a system 200 corresponding to the system of FIG. 1, but in this embodiment, the light source 110 is positioned on the side of the sample 106. A mirror 115 is used to direct the light beam 112 onto the sample from side, not the back, as was the case in FIG. 1.

Detector and optical components associated with the invention have now been described. Attention presently turns toward the image processing associated with the invention. This image processing periodically results in sample repositioning for optimal MALDI performance, as discussed below.

Figure 3:
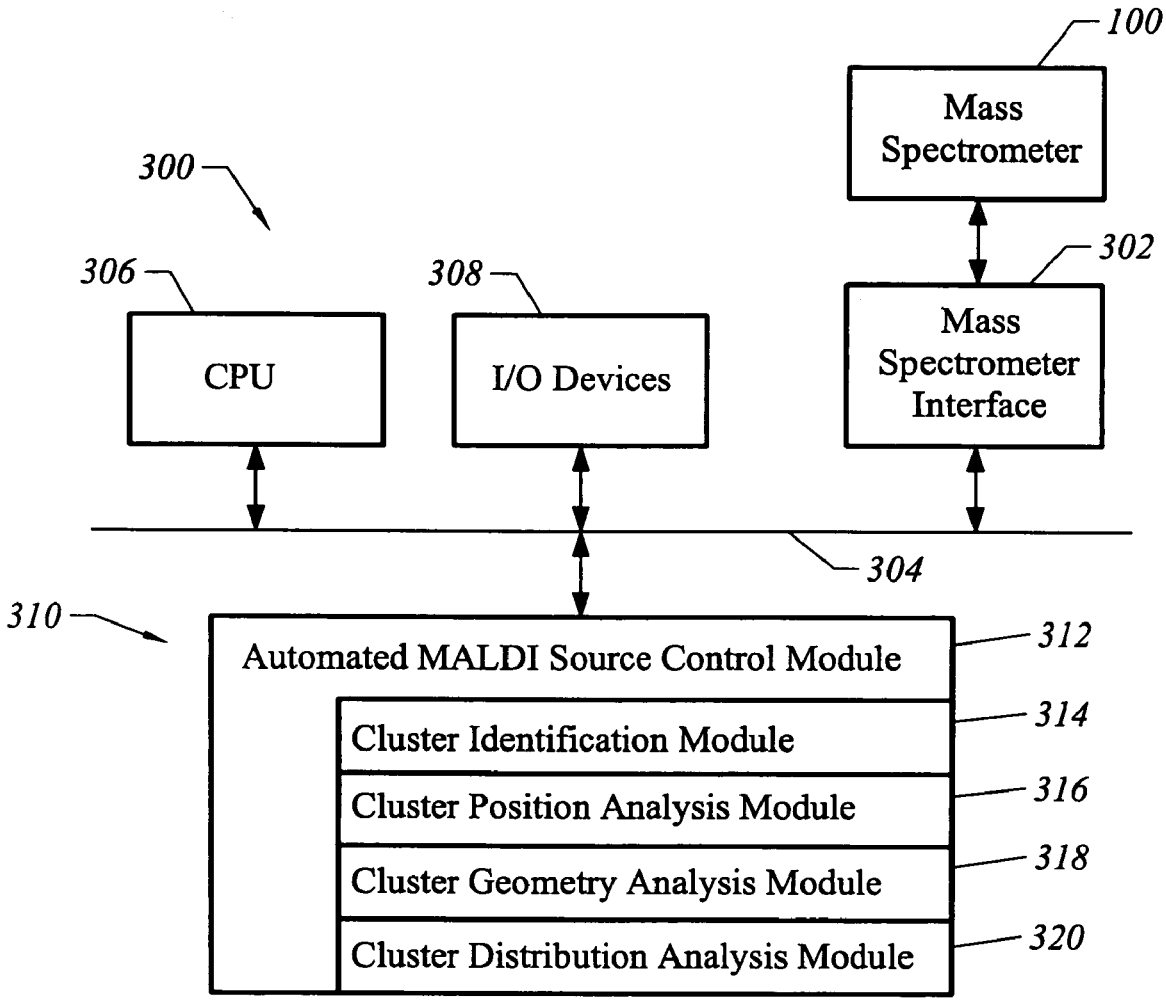
FIG. 3 illustrates an automated MALDI source control system configured in accordance with an embodiment of the invention.

FIG. 3 illustrates an automated MALDI source control system 300 configured in accordance with an embodiment of the invention. The system 300 includes a mass spectrometer interface 302, which includes interface circuitry to attach to components of the mass spectrometer 100 of FIG. 1. Thus, for example, the mass spectrometer interface 302 can include interfaces to the detector 102, the stage position controller 109, the light-source 110, the laser 116, and the camera 126. The mass spectrometer interface 302 receives data from the mass spectrometer 100 and applies control signals to the mass spectrometer 100. Interfaces of this type are known in the art.

The mass spectrometer interface 302 is connected to a bus 304. A central processing unit 306 is also connected to the bus 304. Input and output devices 308 are also connected to the bus. The input and output devices 308 may include a keyboard, mouse, video monitor, printer, and the like.

A memory 310 is also connected to the bus 304. The memory 310 stores an automated MALDI source control module 312 configured in accordance with an embodiment of the invention. The source control module 312 includes a set of executable instructions to perform operations specified below. In one embodiment, the source control module 312 includes a cluster identification module 314. As previously indicated, a cluster is a group of crystals. More particularly, in the image-processing context of the invention, a cluster is a collection of spots representing crystalline characteristics of a sample. The cluster identification module 314 includes executable instructions to identify one of the largest clusters in a processed image.

A cluster position analysis module 316 may also be used in accordance with an embodiment of the invention. The cluster position analysis module 316 includes executable instructions to confirm that the position of a selected cluster meets specified positional criteria that will foster successful results.

The memory 310 also stores a cluster geometry analysis module 318. This module includes executable instructions to confirm that a processed cluster meets certain geometrical criteria, which serves to confirm that an actual cluster is being processed, as opposed to an artifact, such as a scratch on a sample holder 108.

A cluster distribution analysis module 320 may also be used to assess the internal crystal distribution of a processed cluster. In one embodiment, the cluster distribution analysis module 320 includes executable instructions to assess the crystal density distribution of a processed cluster.

The memory 310 may also store image information captured from the camera 126; the memory may also store stage position control programs, laser control programs, and the like. While the invention is successfully operated with standard modules of this type, the invention is largely focused on the automated MALDI source control module 312.

Figure 4:
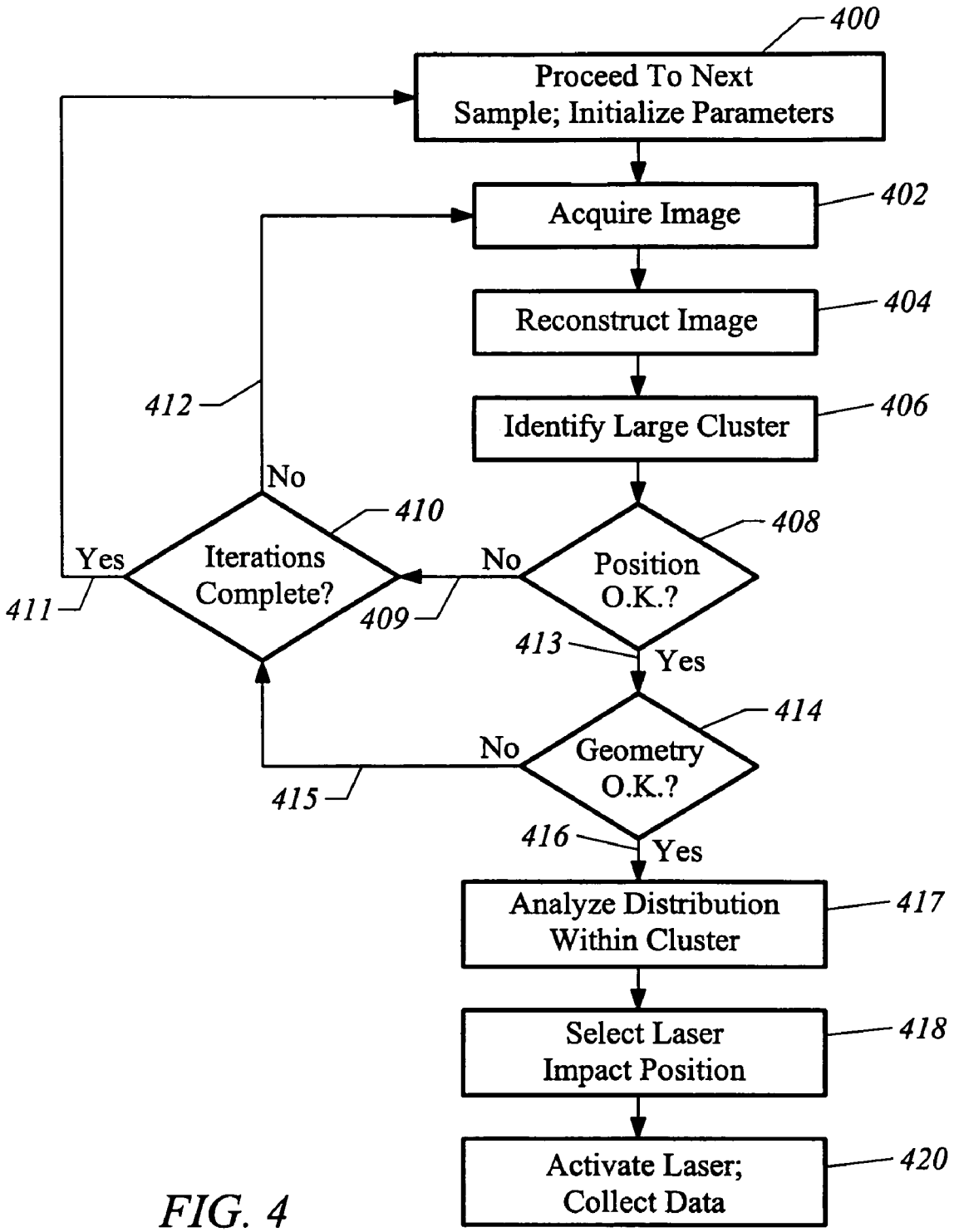
FIG. 4 illustrates automated MALDI source control operations performed in accordance with an embodiment of the invention.

FIG. 4 illustrates an example of automated MALDI source control operations performed in accordance with an embodiment of the invention. The first processing operation of FIG. 4 is to proceed to a sample and initialize parameters (block 400). As discussed in connection with FIG. 1, a stage position controller 109 positions a sample 106 so that a laser beam 118 can impact it. In one embodiment of the invention, an integer count ("mcount") parameter is set to 0 and a Boolean parameter "Largest" is set to true. In addition, an initial plate location is stored, a threshold parameter for edge detection is set, and a nearest neighbor distance is defined. These parameters are discussed below.

Figure 5:
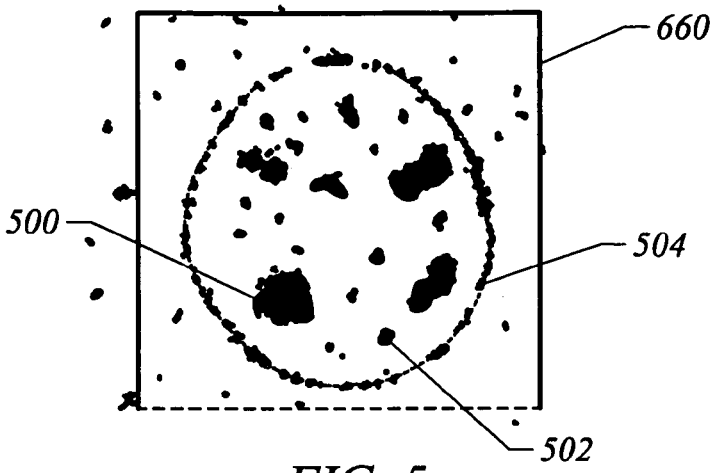
FIG. 5 illustrates a sample image processed in accordance with an embodiment of the invention.

The next operation of FIG. 4 is to acquire an image of a sample (block 402). The apparatus of FIG. 1 or 2 may be used to acquire an image of a sample. FIG. 5 is a schematic example of an image that may be captured and processed in accordance with an embodiment of the invention. The image includes a cluster, which is a collection of spots representing sample crystals. With some matrices and analytes, large spots 500 and small spots 502 are observed. Sometimes the boundary of the sample is delineated by a series of small spots 504. In other examples, the sports are concentrated along the boundary, with relatively few toward the center of the sample. When contrast methods are used in image processing, as in the prior art, large spots 500 are chosen for the laser beam target. However, it has been discovered in the present invention that laser beam ionization of small spots 502 or groups of small spots is often far more effective, giving more analyte ions with higher signal to noise ratios.

The image processing scheme of the present invention can avoid the problems introduced by using image contrast in the choice of target.

Figure 6A:
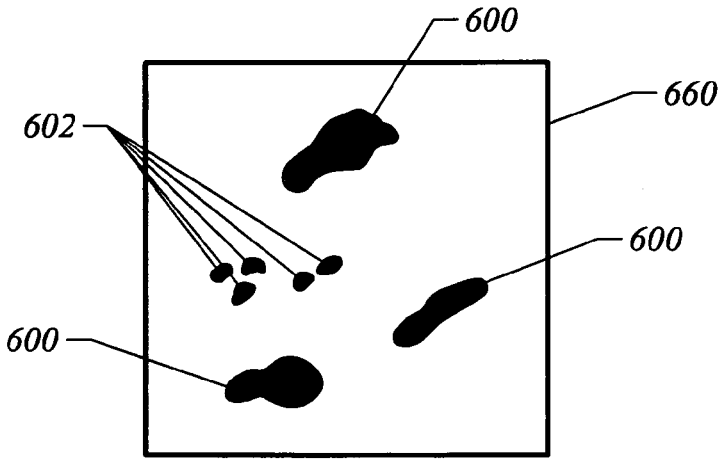
FIGS. 6A-6B illustrate image reconstruction performed in accordance with an embodiment of the invention.

FIG. 6A illustrates large spots 600 and small spots 602 that might be found in a typical image. The image of FIG. 6A is reconstructed according to the operation of block 404 in FIG. 4. To form the reconstructed image, the original image is processed to identify edges of spots. This may be done, for example, using the Canny edge detection algorithm. The result will be an image that may be schematically represented in FIG. 6B, which is a reconstructed image corresponding to the original image of FIG. 6A. In the figure, edges are illustrated as dark against a white background, but they could just as easily have been displayed as white against a dark background. The image is divided in the usual manner into pixels and each pixel is labeled as to whether it contains an edge. If so, the pixel is assigned a value 1, for example, if not, a value 0. These are arbitrary assignments, but convenient for manipulation. Pixels containing an edge are called "atoms". In summary, the reconstructed image is a set of pixels, some of which are atoms (The subdivision of the reconstructed image into pixels is not shown in FIG. 6C.)

Figure 6B:
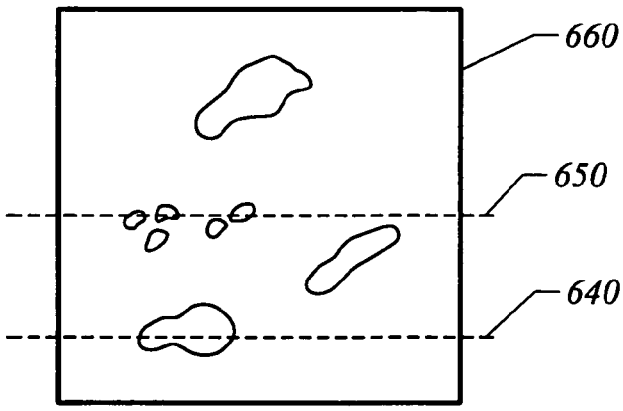

The value of edge detection for locating useful spots is illustrated in FIG. 6B. A line 640 drawn across the image intersects two atoms. The line 650 drawn in a similar manner intersects six atoms. The higher count corresponds to a group of small spots. Although the actual process of counting atoms is from a 2-dimensional array, this 1-dimensional example demonstrates the principle.

The next processing operation of FIG. 4 is to identify a large cluster within the reconstructed image (block 406). The identification of a large cluster can be performed using a variety of techniques. FIG. 7 illustrates example code description and annotations associated with one technique that may be used in accordance with an embodiment of the invention.

As shown in FIG. 7, neighboring atoms are assigned to a cluster in accordance with a radial cut off value. In other words, if an atom is within a specified radial distance of another atom, the two atoms are assigned to the same cluster. This processing results in identification of one or more clusters. The cluster with the largest size is then selected for further processing. Recall that the Boolean variable "largest" was initially set to true. On the first processing pass, the largest cluster will be processed in view of this Boolean variable setting. On a second pass, the Boolean variable setting will be false, as demonstrated below, which results in the next largest size cluster being selected for further processing. Multiple clusters may be processed, but in one embodiment of the invention, only the two largest clusters are processed for any given sample. If these clusters do not meet specified criteria, a subsequent sample is processed or the existing sample is targeted through a best guess positioning of the laser beam, as discussed below.

The position of the selected cluster is then checked (block 408). A bounding box around the cluster may be defined. For example, FIG. 5 illustrates a bounding box 660 associated with a cluster. The bounding box encloses the spots associated with the cluster. By way of example, the bounding box may be defined as a rectangle with an Area=($X_{min}$, $Y_{min}$, $X_{max}$, $Y_{max}$). The physical center of this bounding box may then be readily calculated. The physical center of the bounding box may, if desired, be then compared with a position that corresponds to the location of the device that deposited the sample, i.e., the expected position of the sample. A threshold distance between the physical center and the depositing device position is defined. If the threshold distance is exceeded, then the position is not acceptable, and processing proceeds to branch 409 of FIG. 4. If the threshold distance is not exceeded, then there is positional correspondence between the physical center and the depositing device position. In this case, processing proceeds to branch 413 of FIG. 4. In general, one expects a large cluster beneath the depositing device, which in some embodiments may be a capillary device. The invention endeavors to exploit this fact by only allowing clusters within a threshold distance of the depositing device to be considered for further processing. This test also insures that the laser beam is not directed to the periphery of the sample, which is likely to produce inferior results.

Figure 9:
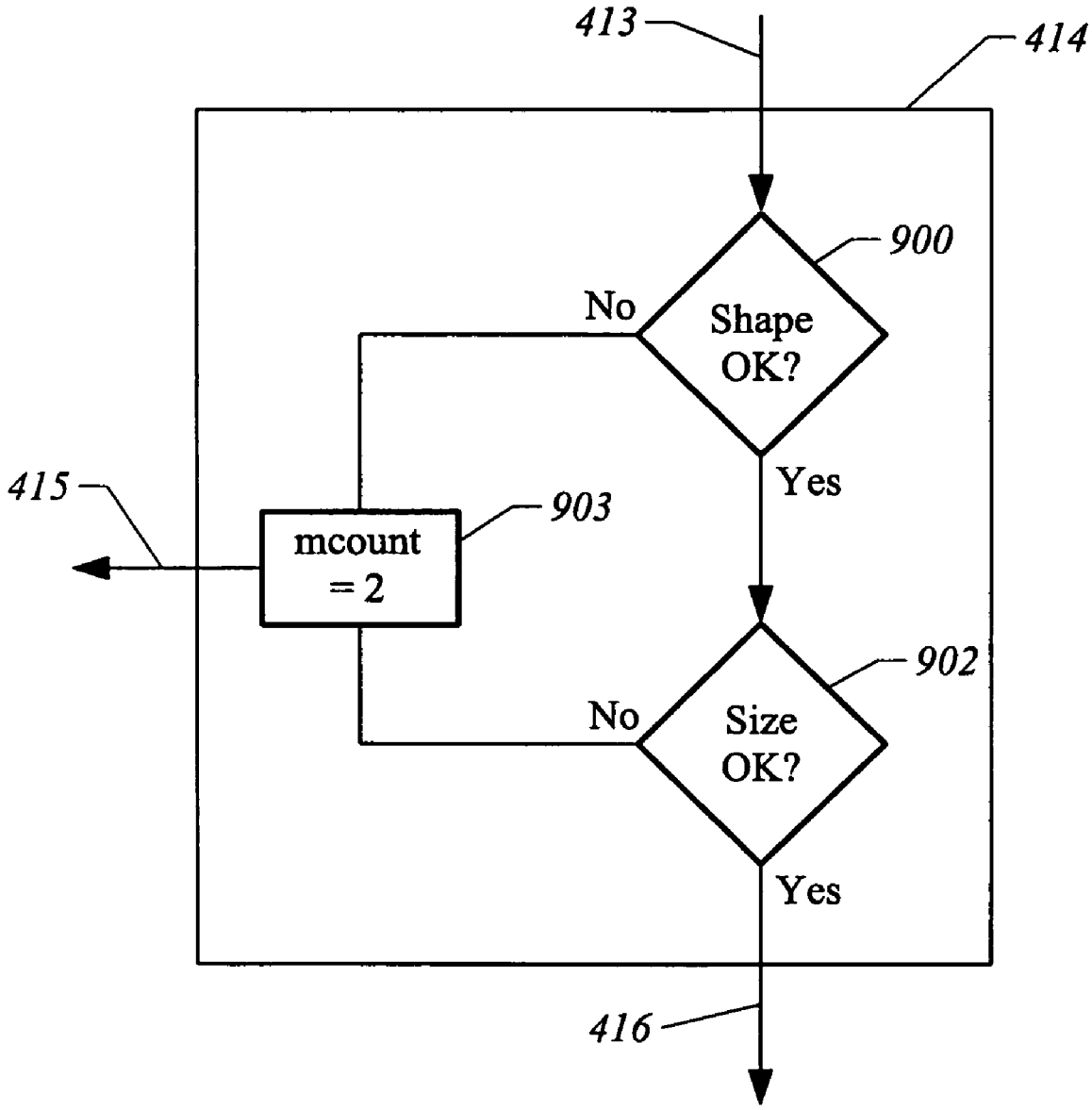
FIG. 9 illustrates geometry processing performed in accordance with an embodiment of the invention.

As shown in FIG. 4, if the position is acceptable, the geometry of the cluster is tested at block 414. FIG. 9 illustrates an example of geometry processing operations that may be formed in accordance with an embodiment of the invention. At block 900 the shape of the cluster is tested. So, for example, criteria may be established that favors a bounding box with a rectangular shape that is not disproportionately distorted in the width or length dimensions. For example, the length and width may be tested as follows:

$$|\text{length}-\text{width}|/(\text{length}+\text{width})<M$$

By keeping M less than ½, and preferably less than ⅓, a test for a relatively "square" rectangle is maintained. Such a shape is typically consistent with a strong cluster sample and otherwise eliminates artifacts in the form of scratches. If the condition of block 900 is met, processing proceeds to block 902.

Block 902 applies a size test. In this example, the area of the bounding box must exceed some specified threshold. This test insures that an adequate cluster will be vaporized and otherwise distinguishes between small visual artifacts that should not be treated as suitable samples. If the size criterion is met, processing proceeds along branch 416. If the shape or size criteria are not met, then the integer mcount variable 903 is assigned a value of 2 at block 903. As shown below, this variable value forces a stage movement that should render a more successful result on a subsequent pass.

As shown in FIG. 4, if the positional and geometrical checks fail, processing proceeds to block 410. In short, block 410 tests to determine whether an appropriate number of iterations have been completed for this sample. The appropriate number of iterations may be configurable. In this example, the number of iterations is controlled by the integer variable mcount and the Boolean variable largest.

Figure 8:
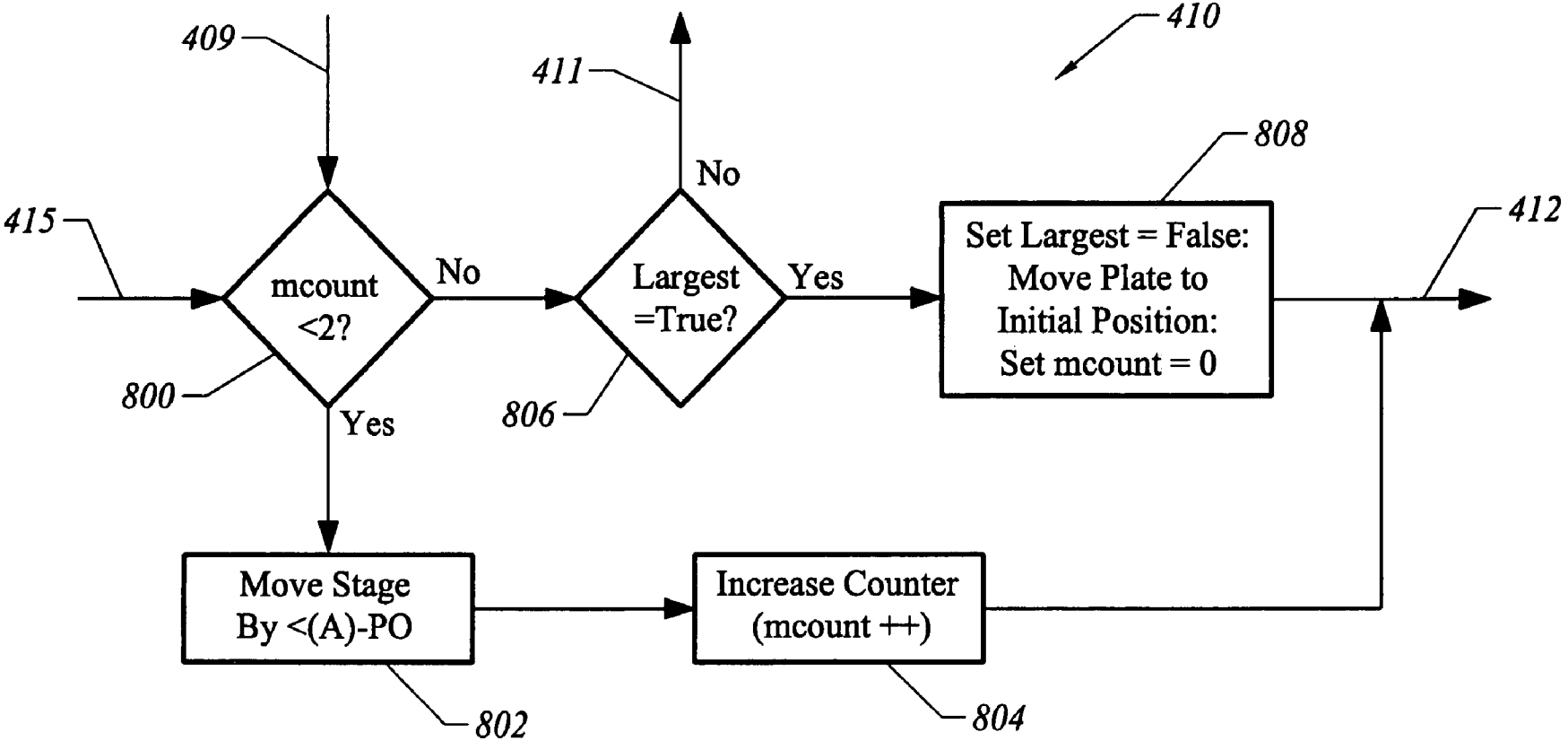
FIG. 8 illustrates iteration count processing operations performed in accordance with an embodiment of the invention.

The decision block of FIG. 8, block 800, initially determines whether the count variable (mcount) is less than two. Recall that the mcount variable was initialized to zero. Therefore, on a first pass, if the position is not acceptable (block 408—NO), then the mcount variable will be less than zero and processing proceeds to block 802. Block 802 forces movement of the stage. In this example, the stage is moved a distance defined by the difference between the depositing device position (C(A)) and the physical center of the bounding box (Po). The variable counter mcount is then incremented at block 804. Processing then proceeds to branch 412 and another image is acquired (block 402).

If the selected cluster of the subsequent image fails the position test of block 408, the mcount variable has a value of 1, so processing proceeds through blocks 802 and 804 once again. If the selected cluster of the subsequent image fails the position test of block 408 once again, then the mcount variable has a value of 2 and therefore the no branch of block 800 is followed on this iteration. Recall that the Boolean variable largest was initialized to true. Therefore, on this pass, processing will proceed from block 806 to block 808. The processing associated with block 808 includes repositioning the stage 108 to an initial position. The Boolean variable largest is set to false, causing the technique to process the second largest cluster, since the largest cluster was deemed inappropriate. Finally, the mcount variable is set to 0 in block 808. The output of block 808 is branch 412, which leads to image acquisition at block 402. Processing of the second largest cluster will continue until the mcount value reaches 2 and the position test of block 408 is failed once again. In this case, the mcount test of block 800 leads to block 806. Since the Boolean variable largest is false at this point. This causes branch 411 to be followed, which results in a new sample being processed. This branch basically represents the failure to find an adequate cluster for processing. Instead of immediately proceeding to the next sample, the current sample can be processed through a random application of the laser beam, if desired.

Recall that the geometry check block 414 sets the mcount variable to a value of 2. In this case, when mcount is compared to the value 2 at block 800 of FIG. 8, the no branch is again followed to block 806. In the first pass through, the Boolean variable largest is still true and therefore processing once again proceeds to block 808. If the geometry test is failed on the following pass, then block 806 produces a no result and processing proceeds to block 400. As discussed above, the sample can be processed with a random laser shot prior to processing the next sample.

Figure 10:
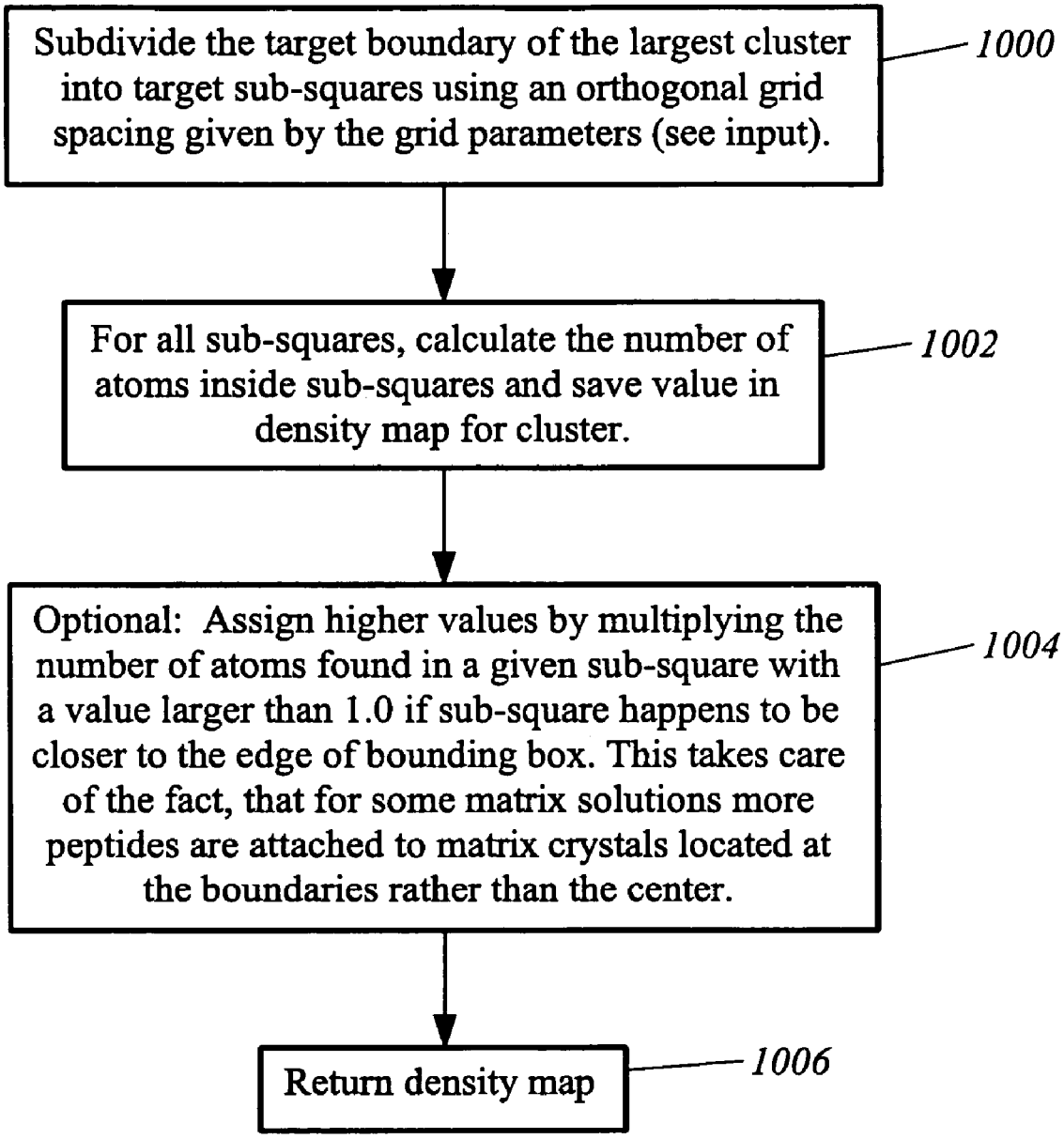
FIG. 10 illustrates cluster distribution processing performed in accordance with an embodiment of the invention.

Returning to FIG. 4, if the positional and geometrical tests are satisfied, a distribution test is applied. In particular, the crystal distribution within the cluster is analyzed. FIG. 10 illustrates an example of distribution processing performed in accordance with an embodiment of the invention. In one embodiment, the distribution processing is in the form of an analysis of the density distribution of spots within the cluster. FIG. 10 illustrates a first processing block 1000 which subdivides the target boundary of the largest cluster into target sub-squares using an orthogonal spacing grid, such as a spacing grid associated with the previously described bounding box. Next, for all sub-squares, the number of atoms inside the sub-square is saved as a value in a density map for the cluster (block 1002). Block 1004 illustrates an optional operation of assigning higher values by multiplying the number of atoms found in a given sub-square with a value larger than 1 if the sub-square is closer to the edge of a bounding box. This accommodates the fact that for some matrix solutions, more peptides are attached to matrix crystals located at the boundaries of the sample, rather than at the center. The foregoing processing results in a density map, which is returned for subsequent processing (block 1006).

Figure 11:
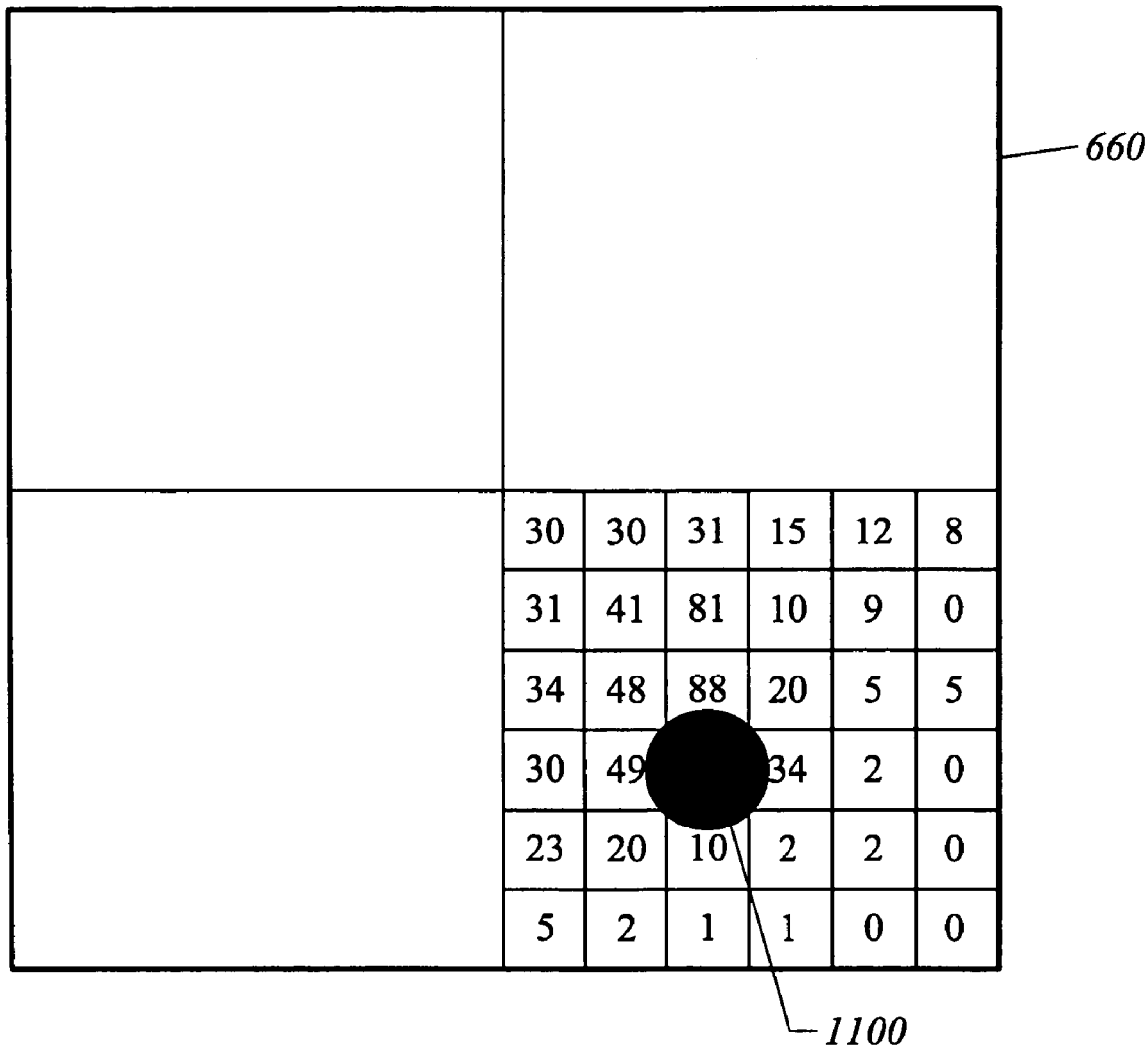
FIG. 11 illustrates a laser beam position selection operation performed in accordance with an embodiment of the invention.

The next processing operation of FIG. 4 is to select a laser impact position (block 418). FIG. 11 illustrates an example of a density map that may be used to select laser impact position. The figure illustrates the bounding box 660 for the cluster. The lower right hand quadrant of this bounding box 660 has a number of sub-squares, each with a number representative of the number of atoms associated with a sub-square. In this example, the grid size of the sub-squares is about the diameter of a laser spot, which is indicated by circle 1100. In this example, the laser spot is positioned on the center of the sub-square with the highest density.

The laser is then activated (block 420). This causes vaporization of the sample and subsequent processing by the detector 102. The laser shooting pattern forces the laser to move to sub-squares with higher scores and to avoid sub-squares with lower scores. Certain randomness can be utilized in the laser motion. The amount of laser shots in between moving the laser spot depends on the repetition frequency setting of the laser. Current lasers are 10 Hz or 100 Hz lasers. The amount of shots in-between moving the laser spot is therefore somewhere between 1 and over 100. How many laser pulses are fired at a sub-square without moving the laser spot will also depend on the power of the laser beam and how well the beam can be focused.

Those skilled in the art will appreciate a number of advantages associated with the invention. First, the invention provides automated assessment of samples to identify optimal locations for laser impingement. The automated assessment technique includes analyses of position, geometry, and internal distribution of a candidate cluster within a sample. The automated technique of the invention may provide a correlation of spot quality and measured results for better diagnostics, the early detection of problems (e.g., a sample dispenser problem), and comprehensive data to facilitate future system enhancements. Advantageously, the invention provides an image processing technique that is fast, customizable and robust.

Notwithstanding the numerous benefits associated with the embodiments discussed up to this point, improvements over these embodiments are possible. Observe that in the MALDI mass spectrometer systems 100 and 200 of FIGS. 1 and 2, respectively, the image capture operations take place within the mass spectrometer 100, which is also referred to as an ionization source. There are spatial and optical limitations associated with this configuration. For example, it is difficult to position an in-source camera closer than approximately 3 cm to the sample holder 108. This relatively large distance reduces resolution. The materials associated with state of the art sample holders, which tend to have favorable chemical properties, but poor optical properties, can exacerbate this resolution problem. The relatively constrained space of the source also reduces illumination and microscopy options. Thus, there is a need to exploit the invention's ability to analyze sample morphology, while providing enhanced mechanisms for sample analysis in order to improve overall spectral quality.

Figure 12:
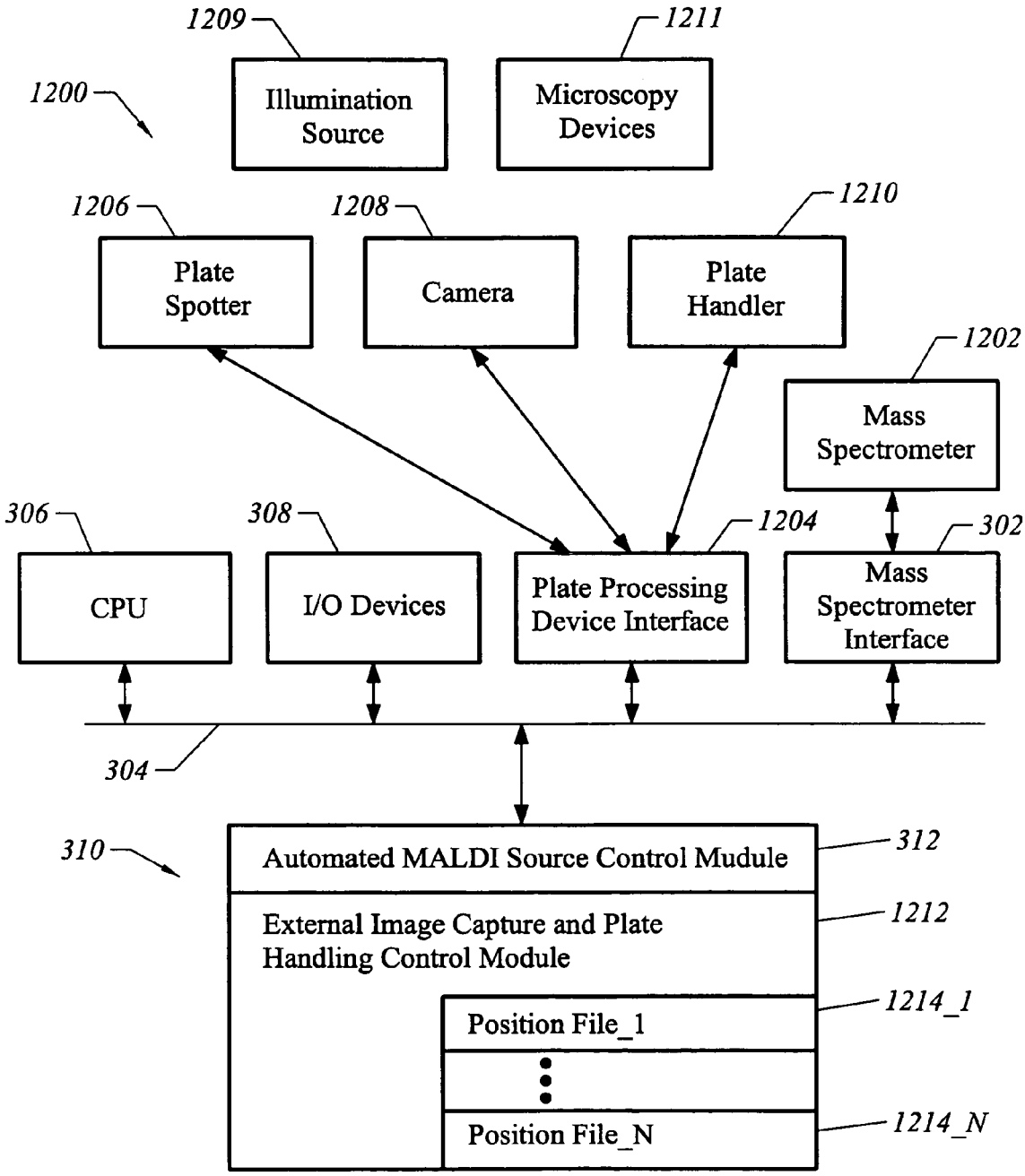
FIG. 12 illustrates an automated MALDI source control system with external image capture and plate handling in accordance with an embodiment of the invention.

The exemplary apparatus of FIG. 12 provides these benefits. The apparatus 1200 of FIG. 12 includes many of the components discussed in connection with FIG. 3, including a mass spectrometer interface 302, a bus 304, a control circuit (e.g., a CPU) 306, optional input/output devices 308, a computer readable medium 310, and the automated MALDI source control module 312. However, the apparatus 1200 includes additional components to provide enhanced functionality. In this embodiment, the mass spectrometer interface 302 is connected to a mass spectrometer 1202 that does not require sophisticated in-source imaging components. Instead, simplified in-source imaging components may be used, for example to provide device registration information, but not sample morphology information.

The apparatus 1200 of FIG. 12 includes a plate processing device interface 1204. The plate processing device interface 1204 may be connected to an automated plate spotter 1206, which applies samples to a sample holder 108. Alternately, a sample holder 108 may receive samples through a manual process. The plate processing device interface 1204 is also connected to a camera (e.g., a digital camera or high-resolution scanner) 1208, which captures an image of samples on a sample holder 108 outside of the mass spectrometer 1202. By capturing an image of the sample holder 108 outside of the mass spectrometer 1202, the camera 1208 can be moved extremely close to the sample holder 108, thereby overcoming a limitation associated with an in-source camera. The camera 1208 has an associated illumination source 1209 and, optionally, microscopy devices 1211. By capturing an image of the sample holder 108 outside of the source, additional illumination and microscopy techniques are available, as discussed below.

A plate handler (e.g., a robot or jukebox) 1210 is also connected to the plate processing device interface 1204. As implied by its name, the plate handler 1210 handles plates or sample holders 108, positioning the plates at a station associated with the plate spotter 1206 and a station associated with the camera 1208. In addition, the plate handler 1210 operates to move plates in and out of the mass spectrometer 1202. In certain embodiments of the invention, the plate handler 1210 is omitted and manual loading operations are performed.

In addition to the automated MALDI source control module 312 stored in memory 310, in this embodiment, an external image capture and plate handling control module 1212 is also stored. The external image capture and plate handling control module 1212 includes executable instructions to direct the operation of the plate spotter 1206, the camera 1208, and the plate handler 1210. The external image capture and plate handling control module 1212 operates in conjunction with the automated MALDI source control module 312 to produce position files 1214_1 through 1214_N. Each position file 1214 defines the position of various samples on a plate. In addition, the techniques described in connection with the automated MALDI source control module 312 are used to characterize the internal morphology of each sample. Thus, each position file 1214 includes information on the position of each sample on a plate, along with information on the internal morphology of each sample, using the techniques described above. The position information may be used alone in subsequent processing of the plate. Alternately, the position information and the internal morphology of each sample may be used in subsequent processing of the plate.

Figure 13:
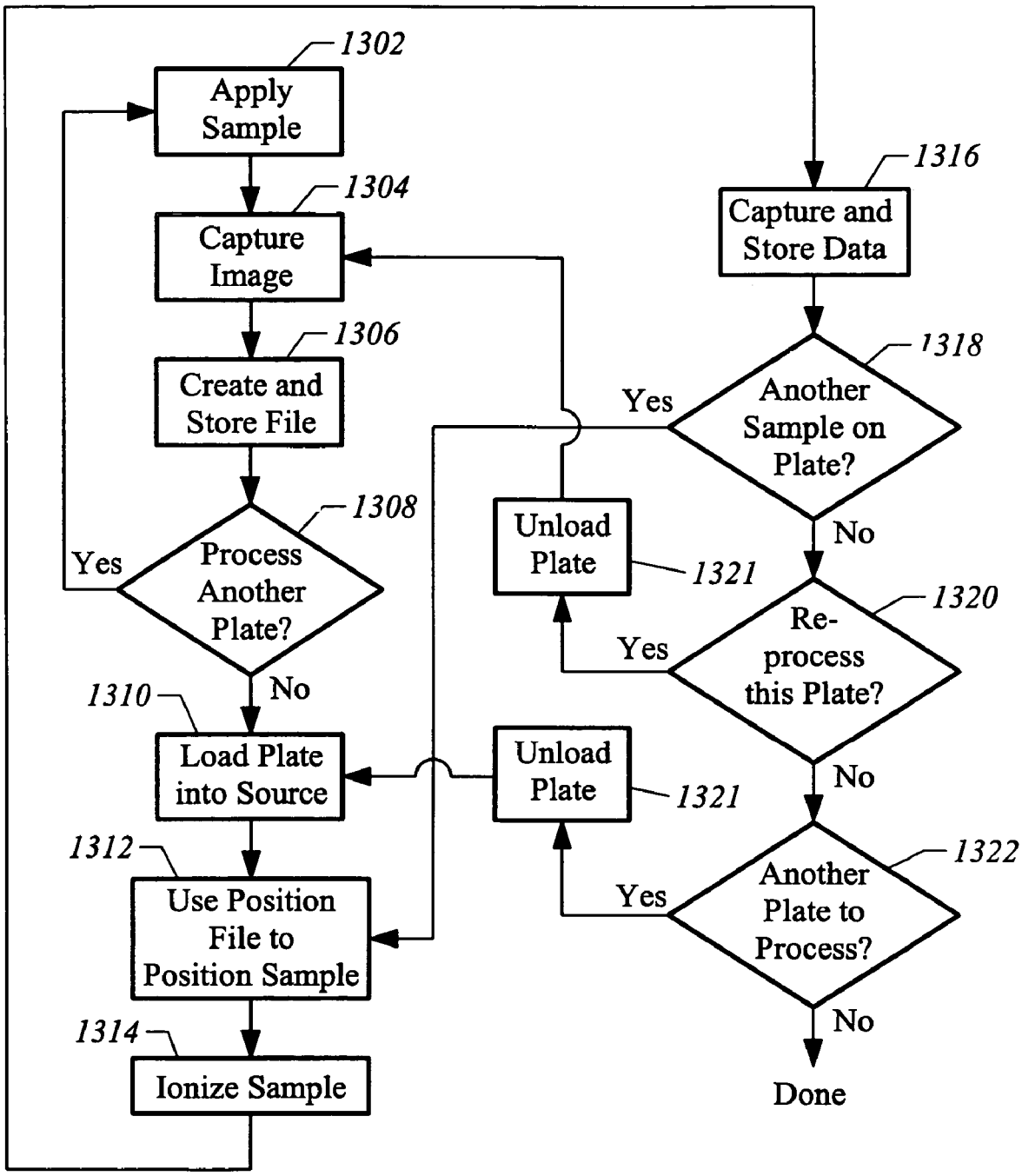
FIG. 13 illustrates processing operations performed by the apparatus of FIG. 12.

Operations associated with an embodiment of the external image capture and plate handling control module 1212 are illustrated in FIG. 13. The first processing operation of FIG. 13 is to apply samples to a plate (1302). The control module 1212 includes executable instructions to direct the plate spotter 1206 to deposit samples on a plate. A manual process may also be used to deposit samples on a plate, or the samples may be deposited under control of a system independent of apparatus 1200.

The next operation of FIG. 13 is to capture an image of the plate outside of the source (1304). Executable instructions associated with the control module 1212 direct the plate handler 1210 to position a plate at an image station associated with the camera 1208. A manual operation may also be used to position a plate at the image station. Executable instructions then direct the camera 1208 to capture an image of the plate. In response, a position file is created and stored (1306). As previously indicated, the position file includes information on the position of each sample. In addition, the automated MALDI source control module 312 supplies internal morphology information for each sample.

The next operation associated with the embodiment of FIG. 13 is to determine whether another plate is to be processed at this time (1308). If so, processing returns to operation 1302. For example, the plate handler 1210 may be used to obtain another plate and position the plate at a station associated with the plate spotter 1206. Alternately, a manual process may be used to position a new plate at a plate spotter or a plate may be spotted manually or with a system independent of apparatus 1200.

If another plate is not to be processed at this point, the original plate is loaded into the source (1310). For example, executable instructions associated with the control module 1212 may be used to direct the plate handler 1210 to position the plate within the mass spectrometer 1202. The plate need not be loaded into the mass spectrometer at this point in time. An embodiment of the invention includes a process where a plate is stored prior to being loaded into a mass spectrometer.

The next operation associated with FIG. 13 is to precisely position the plate in accordance with the data in the position file (1312). For example, executable instructions associated with the control module 1212 direct the stage position controller 109 to position the stage 105 in a position that will result in the laser 116 impacting a favorable configuration of crystals within a sample, as defined by the position file. The position file may be transferred from the apparatus 1200 to the mass spectrometer 1202 or a processing system associated with the mass spectrometer. In this embodiment, the mass spectrometer or related processing system positions the plate in the source in accordance with information in the position file. The plate may be positioned in accordance with position information in the position file. The plate may also be positioned in accordance with geometry and/or distribution attributes contained in the position file. The decision of where to position the plate may be determined at the mass spectrometer, at a processing devices associated with the mass spectrometer, by the control module 1212 or by an alternate processor.

The sample is then ionized via application of laser energy to the sample (1314). The resultant data is captured and stored (1316). If there is another sample on the plate (YES branch at decision block 1318), then control returns to block 1312. If there is not another sample on the plate to be processed (NO branch at decision block 1318), then a decision is made to determine whether this plate should be re-processed (1320). If so, the plate is unloaded (1321) and control is returned to block 1304. If not, a decision is made to determine whether there is another plate to process (1322). If another plate is to be processed (YES branch at decision block 1322), then the plate is unloaded (1321) and control returns to block 1310. If all of the plates are processed, then this experiment is completed.

Those skilled in the art will recognize a number of benefits associated with this embodiment of the invention. For example, the external image capture technique facilitates a variety of illumination options, including extreme side illumination, episcopic illumination (dark field or bright field), and/or diascopic illumination. In addition, the technique facilitates the exploitation of various microscopy devices, including prisms, filters, polarizers, episcopic fluorescence devices, differential interference contrast devices, and/or fluorescent microscopy devices.

The external position of the image capture apparatus facilitates improved analyses of internal sample morphology. In addition, the technique facilitates the recognition of position recognition markers, such as corner dots and grid lines. Thus, the invention facilitates plate registration upon loading into a source.

The embodiment of FIGS. 12 and 13 also support the processing of multiple plates and automated re-processing of individual plates. Therefore, this embodiment of the invention facilitates automated batch processing and high throughput.

Advantageously, this embodiment of the invention is successfully utilized in high vacuum, medium vacuum, and atmospheric pressure configurations.

The invention is successfully exploited with a variety of plate geometries and distributions. Thus, the techniques of U.S. patent application, "User Customizable Plate Handling for MALDI Mass Spectrometry", U.S. Ser. No. 10/429,234, filed May 2, 2003, may be used in accordance with embodiments of the invention. The latter patent application, which is assigned to the assignee of the present invention, is incorporated by reference. The present invention is particularly useful with the technology of the incorporated reference when the incorporated reference technology is operating under circumstances with a poor concentration of crystals or poor spot visibility. In such circumstances, the external image capture operations and image processing operations of the invention overcome the problems of poor concentration of crystals and/or poor spot visibility.

The embodiments of FIGS. 12 and 13 are exemplary. For example, the embodiment of FIG. 12 may be implemented with the plate processing device interface 1204 being connected to a network link so that the plate processing data is processed across a network, instead of at a single location. For example, different computers on one or more local area networks may control the plate spotter 1206, the camera 1208, the plate handler 1210, and the mass spectrometer 1202.

The embodiment of FIG. 13 implies sequential operations. However, it should be appreciated that the invention may be implemented with a variety of asynchronous operations. For example, plates do not need to be loaded immediately into a source. Instead, they can be stored. In such an embodiment, an identification mechanism for the plate, such as barcode may be used. Alternately, the invention may be implemented using parallel processing operations. For example, the external image capture device may be operating on one plate in parallel with the processing of a second plate in the source.

An embodiment of the present invention relates to a computer storage product with a computer-readable medium having computer code thereon for performing various computer-implemented operations. The media and computer code may be those specially designed and constructed for the purposes of the present invention, or they may be of the kind well known and available to those having skill in the computer software arts. Examples of computer-readable media include, but are not limited to: magnetic media such as hard disks, floppy disks, and magnetic tape; optical media such as CD-ROMs and holographic devices; magneto-optical media such as floptical disks; and hardware devices that are specially configured to store and execute program code, such as application-specific integrated circuits ("ASICs"), programmable logic devices ("PLDs") and ROM and RAM devices. Examples of computer code include machine code, such as produced by a compiler, and files containing higher-level code that are executed by a computer using an interpreter. For example, an embodiment of the invention may be implemented using Java, C++, or other object-oriented programming language and development tools. Another embodiment of the invention may be implemented in hard-wired circuitry in place of, or in combination with, machine-executable software instructions.

The foregoing description, for purposes of explanation, used specific nomenclature to provide a thorough understanding of the invention. However, it will be apparent to one skilled in the art that specific details are not required in order to practice the invention. Thus, the foregoing descriptions of specific embodiments of the invention are presented for purposes of illustration and description. They are not intended to be exhaustive or to limit the invention to the precise forms disclosed; obviously, many modifications and variations are possible in view of the above teachings. The embodiments were chosen and described in order to best explain the principles of the invention and its practical applications, they thereby enable others skilled in the art to best utilize the invention and various embodiments with various modifications as are suited to the particular use contemplated. It is intended that the following claims and their equivalents define the scope of the invention.

The invention claimed is:

1. An apparatus for automated MALDI sample plate processing, comprising:
- a mass spectrometer;
- a camera; and
- a computation device, including:
  - a control circuit, and
  - a computer readable medium connected to said control circuit, said computer readable medium storing executable instructions to:
    - capture an image of a plate produced by said camera,
    - identify attributes of a sample on the plate, the attributes including a geometry attribute and an internal density distribution attribute, and
    - select a laser impact position within said mass spectrometer based upon said attributes.

2. The apparatus of claim 1 further comprising an illumination source associated with said camera.

3. The apparatus of claim 2 wherein said illumination source is selected from an extreme side illumination source, an episcopic illumination source, and a diascopic illumination source.

4. The apparatus of claim 1 further comprising a microscopy device associated with said camera.

5. The apparatus of claim 4 wherein said microscopy device is selected from prisms, filters, polarizers, episcopic fluorescence devices, differential interference contrast devices and fluorescent microscopy devices.

6. The apparatus of claim 1 further comprising a plate spotter connected to said computation device.

7. The apparatus of claim 6 further comprising executable instructions stored in said computer readable medium to direct said plate spotter to deposit samples on said plate.

8. The apparatus of claim 1 further comprising a plate handler to move a plate between a plate spotter, said camera, and said mass spectrometer.

9. The apparatus of claim 8 further comprising executable instructions stored in said computer readable medium to direct said plate handler to load said plate in said mass spectrometer.

10. The apparatus of claim 1 further comprising executable instructions stored in said computer readable medium to decide whether to process another sample on said plate.

11. The apparatus of claim 1 further comprising executable instructions stored in said computer readable medium to assess whether to re-process said plate.

12. The apparatus of claim 1 further comprising executable instructions stored in said computer readable medium to determine whether to process another plate.

13. The apparatus of claim 1, wherein the executable instructions to identify include executable instructions to form a density map with individual regions, wherein each individual region characterizes sample density within the individual region.

14. The apparatus of claim 1, wherein the executable instructions to identify include executable instructions to analyze width and length dimensions of a geometry attribute to identify scratch artifacts.

* * * * *